US011725466B2

(12) United States Patent
Cobb et al.

(10) Patent No.: US 11,725,466 B2
(45) Date of Patent: Aug. 15, 2023

(54) MOLDED COMPOSITE INNER LINER FOR METALLIC SLEEVES

(71) Applicant: Halliburton Energy Services, Inc., Houston, TX (US)

(72) Inventors: James Howell Cobb, Cypress, TX (US); Anand Prakash, Tomball, TX (US); Alexei Korovin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 32 days.

(21) Appl. No.: 17/713,288

(22) Filed: Apr. 5, 2022

(65) Prior Publication Data

US 2022/0228448 A1 Jul. 21, 2022

Related U.S. Application Data

(63) Continuation of application No. 16/400,573, filed on May 1, 2019, now abandoned.

(Continued)

(51) Int. Cl.
*E21B 17/10* (2006.01)

(52) U.S. Cl.
CPC ..... *E21B 17/1042* (2013.01)

(58) Field of Classification Search
CPC ..... E21B 17/1042; E21B 47/017; G01V 3/26
See application file for complete search history.

(56) References Cited

U.S. PATENT DOCUMENTS 4,361,188 A * 11/1982 Russell ..... E21B 41/00 166/321
6,189,618 B1 2/2001 Beeman (Continued)

FOREIGN PATENT DOCUMENTS

CA 2573236 C 2/2010

OTHER PUBLICATIONS

International Search Report and Written Opinion issued in related PCT Application No. PCT/US2019/030251 dated Nov. 27, 2019, 14 pages.

(Continued)

*Primary Examiner* — Tara Schimpf
*Assistant Examiner* — Yanick A Akaragwe
(74) *Attorney, Agent, or Firm* — Benjamin Ford; C. Tumey Law Group PLLC

(57) ABSTRACT

Logging downhole exposes components of logging tools, for example, antennas to abrasive and erosive operating conditions. A protective sleeve may disposed about an antenna assembly to protect the antenna assembly for the downhole operating conditions. To permit transmission and receipt of signals by and too the antenna assembly, slots are formed or disposed in the protective sleeve. A non-conductive composite insert is formed in the slots to protect the internal components of the protective sleeve, for example, the antenna assembly, from the operation conditions. A non-conductive composite inner liner is formed in an annulus of the protective sleeve and adheres to the protective sleeve and the non-conductive composite insert. The non-conductive component insert and inner liner allow signals to be transmitted and received by the antenna assembly so that logging operations can be completed without undue delay and the expense of repairing or replacing worn or damaged components.

19 Claims, 5 Drawing Sheets

Related U.S. Application Data

(60) Provisional application No. 62/683,803, filed on Jun. 12, 2018.

(56) References Cited

U.S. PATENT DOCUMENTS

| | | | | |
|---|---|---|---|---|
| 8,119,047 | B2 | 2/2012 | Moore et al. | |
| 9,540,922 | B2 | 1/2017 | Zhong | |
| 2002/0057210 | A1 | 5/2002 | Frey et al. | |
| 2003/0056984 | A1* | 3/2003 | Smith | G01V 11/002 166/381 |
| 2004/0089401 | A1 | 5/2004 | Patel et al. | |
| 2005/0116718 | A1 | 6/2005 | Chen et al. | |
| 2008/0111554 | A1 | 5/2008 | Wang et al. | |
| 2009/0279960 | A1 | 11/2009 | Hazzan | |
| 2010/0277176 | A1 | 11/2010 | Homan | |
| 2014/0368197 | A1* | 12/2014 | Wang | G01V 3/30 324/333 |
| 2016/0252645 | A1 | 9/2016 | Wisler et al. | |
| 2017/0074324 | A1 | 3/2017 | Hunt et al. | |
| 2017/0160423 | A1 | 6/2017 | Prakash | |
| 2017/0246778 | A1 | 8/2017 | Trowbridge | |
| 2018/0024266 | A1 | 1/2018 | Wang et al. | |

OTHER PUBLICATIONS

International Preliminary Report on Patentability issued in related PCT Application No. PCT/US2019/030251 dated Dec. 24, 2020, 10 pages.

* cited by examiner

MOLDED COMPOSITE INNER LINER FOR METALLIC SLEEVES

CROSS-REFERENCE TO RELATED APPLICATIONS

This application claims priority from U.S. application Ser. No. 16/400,573 entitled "Molded Composite Inner Liner for Metallic Sleeves," filed on May 1, 2019, which claims priority from U.S. Provisional Application Ser. No. 62/683,803 entitled "Molded Composite Inner Liner for Metallic Sleeves," filed on Jun. 12, 2018, the entire disclosures of which are incorporated herein by reference.

BACKGROUND

The present disclosure relates generally to wellbore operations and, more particularly, to a sleeve assembly for a downhole logging tool.

During drilling operations for the extraction of hydrocarbons, a variety of recording and transmission techniques are used to provide or record data downhole, for example, from the vicinity of a drill bit. Measurements of the surrounding subterranean formations may be made throughout drilling operations using downhole measurement and logging tools, such as measurement-while-drilling (MWD) and/or logging-while-drilling (LWD) tools, which help characterize the formations and aid in making operational decisions. Wellbore logging tools make measurements that may be used to determine the electrical resistivity (or its inverse, conductivity) of the formations being penetrated, where the electrical resistivity indicates various features of the formations. Those measurements may be taken using one or more antennas coupled to, within or otherwise associated with the wellbore logging tools.

Logging tool antennas are often formed by positioning coil windings about an axial section of the logging tool, such as a drill collar. A ferrite material or "ferrites" are sometimes positioned beneath the coil windings to increase the efficiency and/or sensitivity of the antenna.

The ferrites facilitate a higher magnetic permeability path (for example, a flux conduit) for the magnetic field generated by the coil windings, and help shield the coil windings from the drill collar and associated losses (for example, eddy currents generated on the drill collar). The antenna must be protected from the harsh downhole environment. Generally, the antennas are protected by positioning a sleeve around the antennas to protect the antennas from abrasion and erosion while the downhole logging tool traverses the wellbore. As the sleeve interferes with the operation of the antennas, slots are formed in the sleeve to provide a dipole angle for the electromagnetic field of the antennas to penetrate the formation or object of interest. However, debris, fluids or other harmful materials could penetrate the slots and damage the antennas. Typically, a non-conductive inner sleeve is inserted into the outer sleeve to cover the slots and protect the antennas or the slots could be filled with an epoxy. Both solutions still allowed for some erosion and exposure of the antennas to the downhole environment. Both solutions increase costs, wear and tear and decrease reliability.

BRIEF DESCRIPTION OF THE DRAWINGS

The following figures are included to illustrate certain aspects of the present disclosure, and should not be viewed as exclusive embodiments. The subject matter disclosed is capable of considerable modifications alterations combinations, and equivalents in form and function, without departing from the scope of this disclosure.

DETAILED DESCRIPTION

Figure 1:
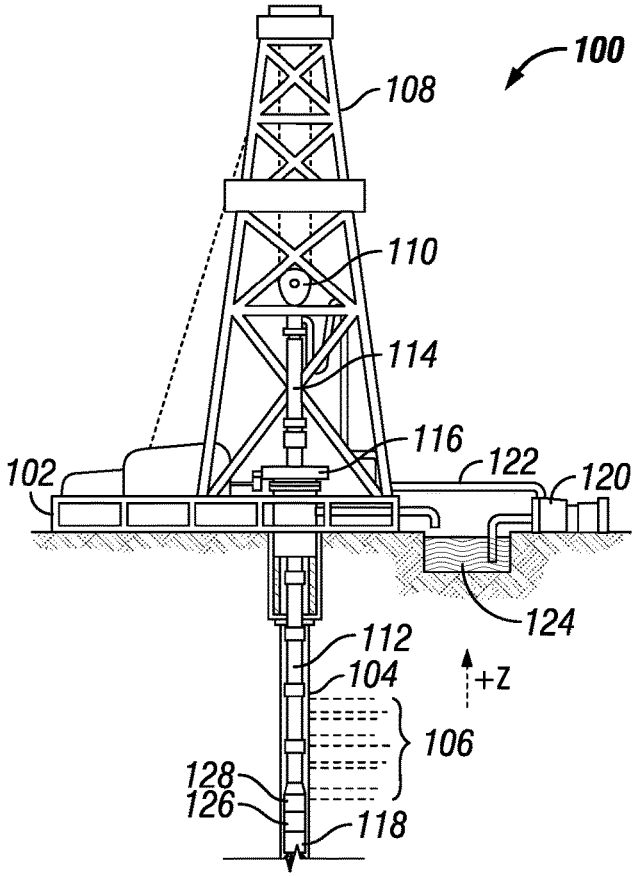
FIG. 1 s a schematic diagram of an exemplary drilling system, according to one or more aspects of the present disclosure.

The present disclosure relates generally to wellbore operations and, more particularly, to a protective sleeve assembly for antennas of a wellbore logging tools used in hydrocarbon drilling operations.

Downhole environments may have harsh operating conditions such as abrasive and erosive fluids including liquids, solid particles, and other debris. During downhole logging operations, for example, measurement while drilling (MWD) and logging while drilling (LWD) operations, a downhole tool that includes an antenna may include sections that include an antenna for receiving data related to a formation of interest or any other object. These antennas are susceptible to damage and catastrophic failure due to the harsh downhole operating conditions. Thus, these antennas must be protected while at the same time provided with the ability to obtain the desired measurements or data.

The antenna may be protected by an outer sleeve. To provide adequate protection from the downhole operating conditions, the outer sleeve is generally constructed using a metallic material that interferes with the operation of the antenna. To provide for proper operation of the antenna, the outer sleeve comprises one or more slots that allow the antenna to transmit and receive signals to and from the downhole tool. However, the slots allow for erosion and abrasion, for example, from a downhole fluid. Typically, a non-conductive inner sleeve is inserted or press-fit into the outer sleeve to provide protection for the antenna and the slots are filled with a non-conductive material. Filling the slots with a non-conductive material protects the antenna from the downhole operating conditions but may not be adequate as the non-conductive material is also susceptible to erosion and abrasion and typically does not bind sufficiently to the inner sleeve. For example, the non-conductive material may comprise an epoxy that breaks, cracks or otherwise weakens during a downhole operation which reduces the life of the outer sleeve, the inner sleeve, the antenna or any combination thereof and requires expensive and time-consuming repair or replacement. Further, the inner sleeve necessarily reduces the available space within the outer sleeve for the antenna and necessary corresponding components. Insertion of the inner sleeve also creates a gap between the inner sleeve and the outer sleeve. Repairing the outer sleeve and the inner sleeve with the epoxy filled slots may be time-consuming, expensive and laborious and may result in delays for completing the downhole operation.

According to one or more embodiments, a composite insert may be disposed or positioned within the slot that provides sufficient boding to the outer sleeve to protect the internal components of the outer sleeve, such as the antenna. A composite insert does not have gaps between the outer sleeve and the insert and is not as susceptible to the downhole operating conditions as the previously used non-conductive material that was injected into the slots. The composite insert provides a reliable and cost-efficient protection for the components of the outer sleeve.

FIG. 1 is a schematic diagram of an exemplary drilling system 100 that may employ the principles of the present disclosure, according to one or more embodiments. As illustrated, the drilling system 100 may include a drilling platform 102 positioned at the surface and a wellbore 104 that extends from the drilling platform 102 into one or more subterranean formations 106. In other embodiments, such as in an offshore drilling operation, a volume of water may separate the drilling platform 102 and the wellbore 104. Even though FIG. 1 depicts a land-based drilling platform 102, it will be appreciated that the embodiments of the present disclosure are equally well suited for use in other types of drilling platforms, such as offshore platforms, or rigs used in any other geographical locations. The present disclosure contemplates that wellbore 104 may be vertical, horizontal or at any deviation.

The drilling system 100 may include a derrick 108 supported by the drilling platform 102 and having a traveling block 110 for raising and lowering a drill string 112. A kelly 114 may support the drill string 112 as it is lowered through a rotary table 116. A drill bit 118 may be coupled to the drill string 112 and driven by a downhole motor and/or by rotation of the drill string 112 by the rotary table 116. As the drill bit 118 rotates, it creates the wellbore 104, which penetrates the subterranean formations 106. A pump 120 may circulate drilling fluid through a feed pipe 122 and the kelly 114, downhole through the interior of drill string 112, through orifices in the drill bit 118, back to the surface via the annulus defined around drill string 112, and into a retention pit 124. The drilling fluid cools the drill bit 118 during operation and transports cuttings from the wellbore 104 into the retention pit 124.

The drilling system 100 may further include a bottom hole assembly (BHA) coupled to the drill string 112 near the drill bit 118. The BHA may comprise various downhole measurement tools such as, but not limited to, measurement-while-drilling (MWD) and logging-while-drilling (LWD) tools, which may be configured to take downhole measurements of drilling conditions. The MWD and LWD tools may include at least one wellbore logging tool 126, which may comprise one or more antennas capable of receiving and/or transmitting one or more electromagnetic (EM) signals that are axially spaced along the length of the wellbore logging tool 126. The one or more antennas are protected by a protective sleeve assembly as discussed below with respect to FIGS. 3A, 3B, 4, 5, 6, 7, 8. As will be described in detail below, the wellbore logging tool 126 may further comprise a plurality of ferrites used to shield the EM signals and thereby increase the azimuthal sensitivity of the wellbore logging tool 126.

As the drill bit 118 extends the wellbore 104 through the formations 106, the wellbore logging tool 126 may continuously or intermittently collect azimuthally-sensitive measurements relating to the resistivity of the formations 106, for example, how strongly the formations 106 opposes a flow of electric current. The wellbore logging tool 126 and other sensors of the MWD and LWD tools may be communicably coupled to a telemetry module 128 used to transfer measurements and signals from the BHA to a surface receiver (not shown) and/or to receive commands from the surface receiver. The telemetry module 128 may encompass any known means of downhole communication including, but not limited to, a mud pulse telemetry system, an acoustic telemetry system, a wired communications system, a wireless communications system, or any combination thereof. In certain embodiments, some or all of the measurements taken at the wellbore logging tool 126 may also be stored within the wellbore logging tool 126 or the telemetry module 128 for later retrieval at the surface upon retracting the drill string 112.

Figure 2:
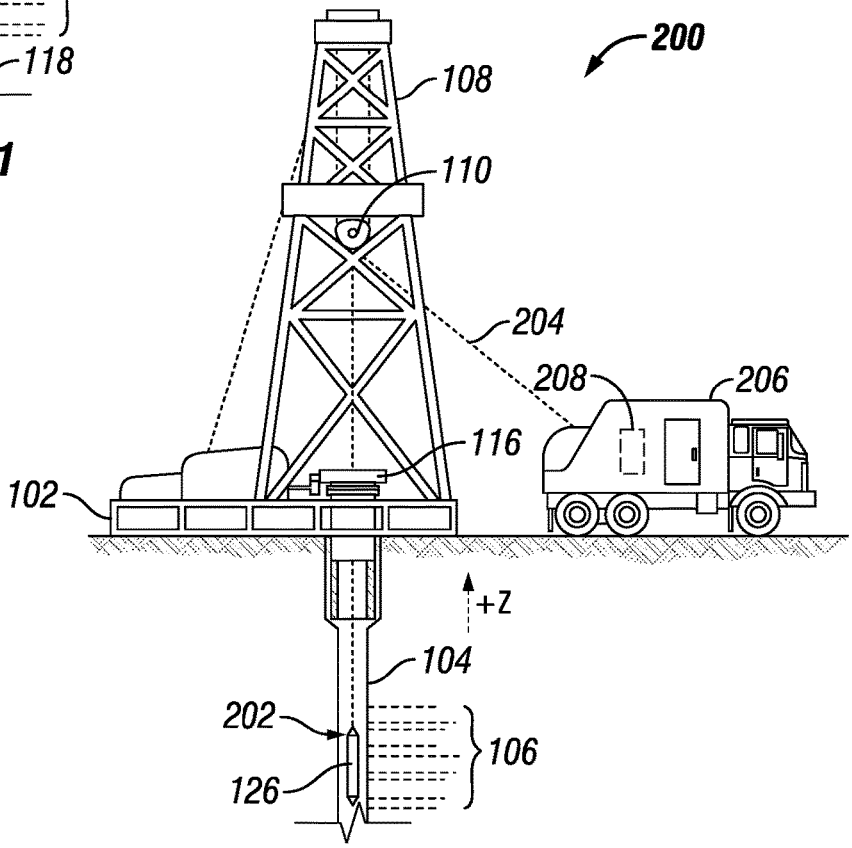
FIG. 2 is a schematic diagram of an exemplary wireline system, according to one or more aspects of the present disclosure.

At various times during the drilling process, the drill string 112 may be removed from the wellbore 104, as shown in FIG. 2, to conduct measurement/logging operations. More particularly, FIG. 2 depicts a schematic diagram of an exemplary wireline system 200 that may employ the principles of the present disclosure, according to one or more embodiments. Like numerals used in FIGS. 1 and 2 refer to the same components or elements and, therefore, may not be described again in detail. As illustrated, the wireline system 200 may include a wireline instrument sonde 202 that may be suspended into the wellbore 104 by a cable 204. The wireline instrument sonde 202 may include the wellbore logging tool 126 described above, which may be communicably coupled to the cable 204. The cable 204 may include conductors for transporting power to the wireline instrument sonde 202 and also facilitate communication between the surface and the wireline instrument sonde 202. A logging facility 206, shown in FIG. 2 as a truck, may collect measurements from the wellbore logging tool 126, and may include computing and data acquisition systems 208 for controlling, processing, storing, and/or visualizing the measurements gathered by the wellbore logging tool 126. The computing facilities 208 may be communicably coupled to the wellbore logging tool 126 by way of the cable 204.

Figure 3A:
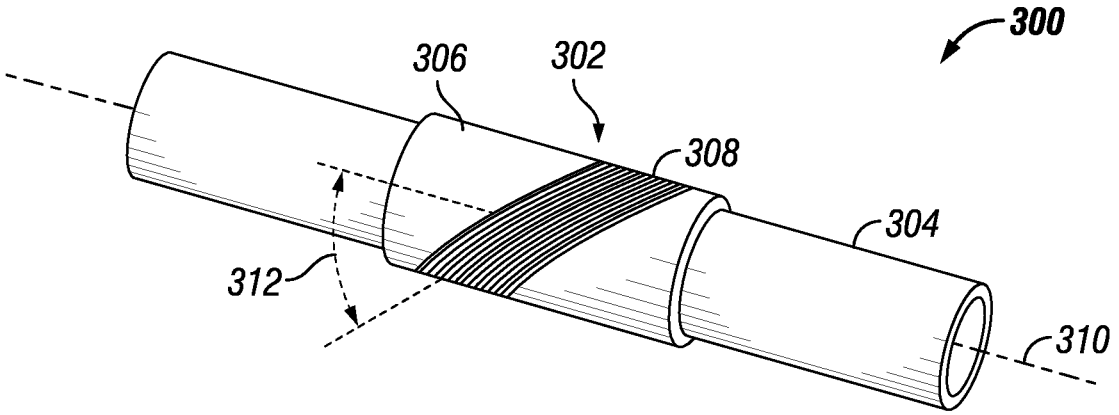
FIG. 3A is a partial isometric view of an exemplary portion of a wellbore logging tool, according to one or more aspects of the present disclosure.

FIG. 3A is a partial isometric view of an exemplary portion 300 of a wellbore logging tool 126, according to one or more aspects of the present disclosure. The portion 300 is depicted as including an antenna assembly 302 that can be positioned about a tool mandrel 304, such as a drill collar or the like and inserted, disposed or position in a sleeve assembly of the wellbore logging tool 126. The antenna assembly 302 may include a bobbin 306 and a coil 308 wrapped about the bobbin 306 and extending axially by virtue of winding along at least a portion of an outer surface of the bobbin 306.

The bobbin 306 may structurally comprise a high temperature plastic, a thermoplastic, a polymer (for example, polyimide), a ceramic, or an epoxy material, but could alternatively be made of a variety of other non-magnetic, electrically insulating/non-conductive materials. The bobbin 306 can be fabricated, for example, by additive manufacturing (for example, 3D printing), molding, injection molding, machining, or other known manufacturing processes.

The coil 308 can include any number of consecutive "turns" (for example, windings of the coil 308) about the bobbin 306, but typically will include at least a plurality (for example, two or more) consecutive full turns, with each full turn extending 360 degrees about the bobbin 306. In some embodiments, a pathway for receiving the coil 308 may be formed along the outer surface of the bobbin 306. For example, one or more grooves may be defined in the outer surface of the bobbin 306 to receive and seat the coil 308. In other embodiments, however, the outer surface of the bobbin 306 may be smooth or even. The coil 308 can be concentric or eccentric relative to a central axis 310 of the tool mandrel 304.

As illustrated, the turns or windings of the coil 308 extend about the bobbin 306 at an angle 312 offset from the central axis 310. As a result, the antenna assembly 302 may be characterized and otherwise referred to as an "antenna," "tilted coil" or "directional" antenna. In the illustrated embodiment, the angle 312 is 45°, by way of example, and could alternatively be any angle offset from the central axis 310, without departing from the scope of the disclosure.

Figure 3B:
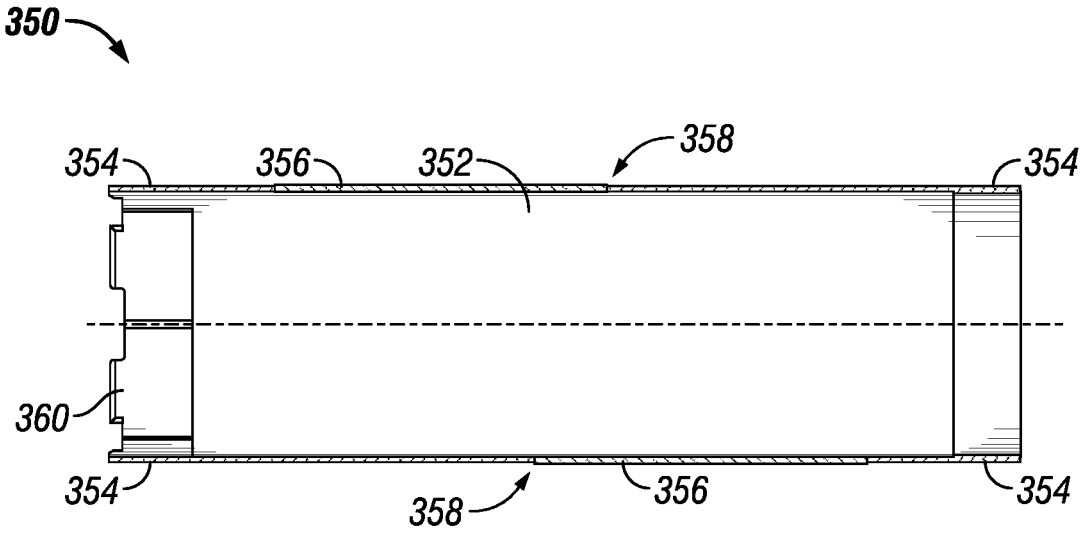
FIG. 3B is a cross-sectional view of a sleeve assembly, according to one or more aspects of the present disclosure.

FIG. 3B is a cross-sectional view of a sleeve assembly 350, according to one or more aspects of the present disclosure. A sleeve assembly 350 comprises a locking mechanism 360, an outer sleeve 354, one or more slots 358 and a non-conductive insert 356. The outer sleeve 354 may comprise any material that includes properties that resist abrasion or erosion due to the downhole operating conditions. For example, the outer sleeve 354 may comprise a metallic material. Outer sleeve 354 comprises an annulus 352. An antenna coil 308 or portion 300 as discussed above with respect to FIG. 3A may be positioned, disposed or inserted in the annulus 352 of sleeve assembly 350. The locking mechanism 360 allows the sleeve assembly 350 to couple to one or more other assemblies, tools or portions of assemblies or tools.

Figure 8:
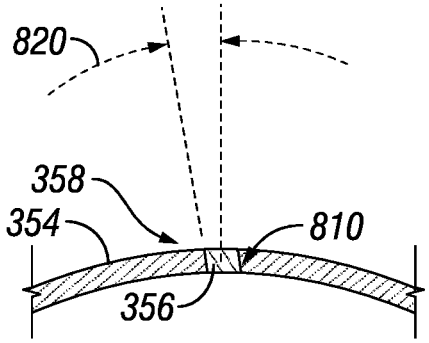
FIG. 8 is a partial cross-sectional view of a sleeve assembly, according to one or more aspects of the present disclosure.
Figure 9:
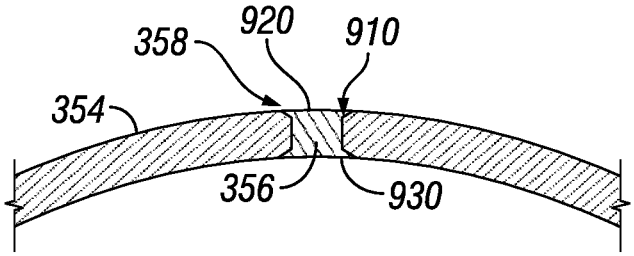
FIG. 9 is a partial cross-sectional view of a sleeve assembly, according to one or more aspects of the present disclosure.

The sleeve assembly 350 comprises one or more slots 358 distributed, formed, positioned or disposed about any one or more portions of the sleeve assembly 350. In one or more embodiments, the sleeve assembly 350 may comprise one or more slots 358 distributed circumferentially at one or more angles as illustrated in the isometric view 500 of the sleeve assembly 350 of FIG. 5. The one or more slots 358 may be any width or length and may be at any angle, aligned axially with any axis, or at any other orientation or positioning. In one or embodiments, the slots may be of any dimension or shape including, but not limited to, rectangular, elongated, elliptical, key-shaped, spiraled, circular, or any other shape for dimension for any aperture or opening. In one or more embodiments, the one or more slots 358 may comprise straight edges, beveled edges, angled edges or any combination thereof. For example, FIG. 8 illustrates a partial cross-sectional view of a sleeve assembly 350 with an outer sleeve 354 that comprises a slot 358. The slot 358 comprises an angled edge 810 at an angle or deviation of 820 from a central axis of the outer sleeve 354. For example, FIG. 9 illustrates a partial cross-sectional view of a sleeve assembly 350 with an outer sleeve 354 that comprises a slot 358 with a beveled edge 910. The slot 358 comprises a non-conductive insert 356 that provides insert retention at a top portion 920 and a bottom portion 930 of the slot 358. The one or more slots 358 overlap with an antenna disposed in the annulus of the outer sleeve 354. For example, an antenna is aligned or at least partially aligned with one or more slots 358 such that the slot allows the antenna, such as an antenna illustrated in FIG. 3A, to function or operate as the one or more slots 358 allow the antenna to transmit or receive one or more signals to and from a formation of interest or any other object.

A non-conductive insert 356 may be disposed or positioned in any one or more of the one or more slots 358. The non-conductive insert 356 may comprise a composite material. The non-conductive insert 358 comprises a material that does not substantially interfere with the functioning or operation of an antenna, for example, as illustrated in FIG. 3A. The non-conductive insert 356 may be formed by any one or more processes including, but not limited to, molding, such as injection molding, subtracted machining, fusing, curing, bonding, masking, any other suitable process or procedure, or any combination thereof The non-conductive insert 356 adheres, bonds, cures, fuses, or otherwise affixes to the outer sleeve 354 such that no or only substantially inconsequential air gaps exists between the non-conductive insert 356 and the outer sleeve 354.

Figure 4:
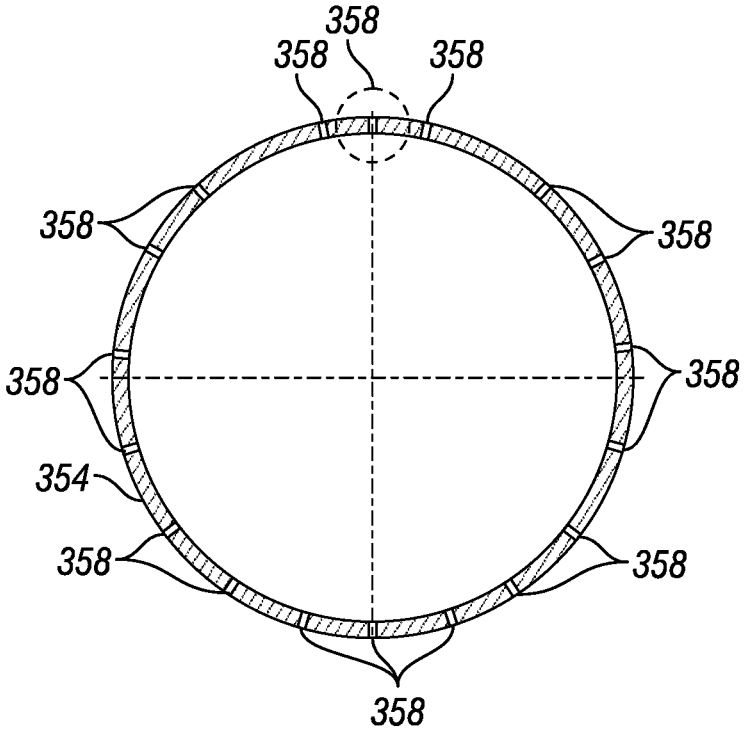
FIG. 4 is a top cross-sectional view of a sleeve assembly, according to one or more aspects of the present disclosure.
Figure 5:
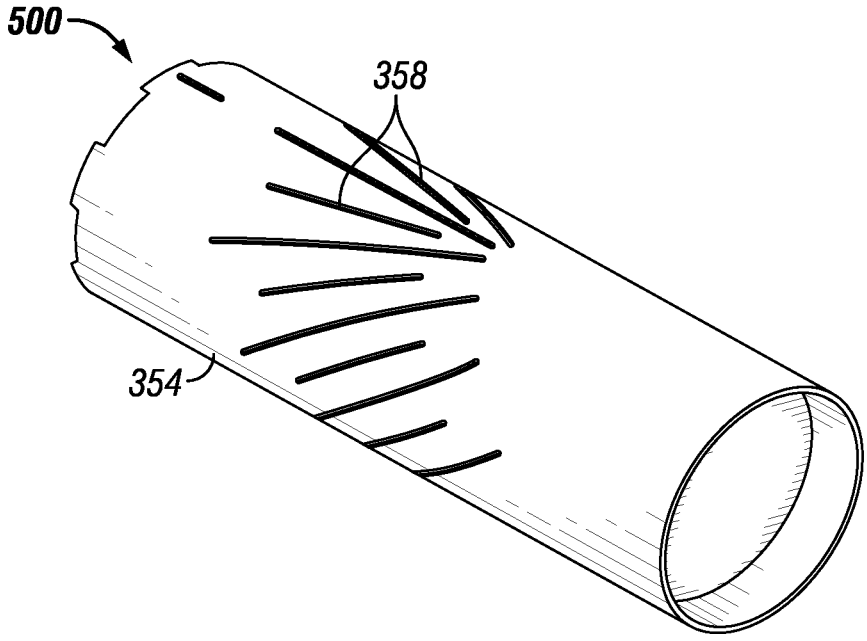
FIG. 5 is an isometric view of a sleeve assembly, according to one or more aspects of the present disclosure.

FIG. 4 is a top cross-sectional view of a sleeve assembly, for example, sleeve assembly 350 of FIG. 3B, according to one or more aspects of the present disclosure. FIG. 4 illustrates one or more slots 358 disposed, positioned or otherwise distributed about an outer sleeve 354.

Figure 6:
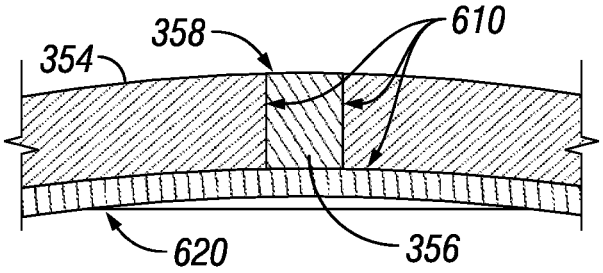
FIG. 6 is a partial cross-sectional view of a sleeve assembly, according to one or more aspects of the present disclosure.
Figure 7:
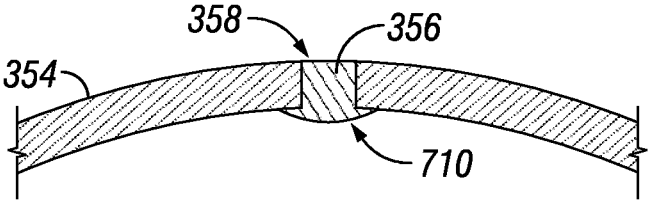
FIG. 7 is a partial cross-sectional view of a sleeve assembly, according to one or more aspects of the present disclosure.

FIG. 6 is a partial cross-sectional view of a sleeve assembly, for example, sleeve assembly 350, according to one or more aspects of the present disclosure. An outer sleeve 354 may comprise a slot 358. The slot 358 may be filled, packed, plugged or otherwise sealed with a non-conductive insert 356 such that non-conductive insert 356 forms bonds 610 with the outer sleeve 354 as discussed above. The seal formed by the non-conductive insert 356 prevents exposure of one or more components disposed or positioned in the annulus 352 of the outer sleeve 354 to erosive or abrasion materials or fluids. The bond 610 may be a chemical bond or a mechanical bond. In one or more embodiments, a non-conductive inner liner 620 may be formed in the annulus 352 of the outer sleeve 354 and adheres to the outer sleeve 354. For example, non-conductive inner liner 620 forms a bond 610 with the outer sleeve 354. The non-conductive inner liner 620 may comprise a composite material. In one or more embodiments, the non-conductive inner liner 620 comprises the composite material as the non-conductive insert 356. The non-conductive inner liner 620 may be formed by any one or more processes including, but not limited to, molding, such as injection molding, subtracted machining, fusing, curing, bonding, masking, any other suitable process or procedure, or any combination thereof. The non-conductive inner liner 620 adheres, fuses, bonds or otherwise affixes to the outer sleeve 354 such that no or only substantially inconsequential air gaps exists between the non-conductive inner liner 620 and the outer sleeve 354. In one or more embodiments, non-conductive inner liner 620 may be a sleeve that is circumferentially formed in the annulus 352. In one or more embodiments, non-conductive inner liner 620 may be formed on one or more portions of or partially circumferentially formed on the outer sleeve 354 in the annulus 352, for example, as illustrated in FIG. 6. For example, the non-conductive inner liner 610 is circumferentially disposed or positioned or otherwise formed in the annulus 352 to form a sleeve that adheres to the outer sleeve without any or with only inconsequential air gaps. FIG. 7 illustrates a partial cross-sectional view of a sleeve assembly 350, according to one or more aspects of the present disclosure. For example, a non-conductive inner liner 620 may form a button-shaped or flanged insert 710. The non-conductive inner liner 620 provides additional structure to maintain the placement or bonding of the inner insert 356 in the slot 358.

Figure 10:
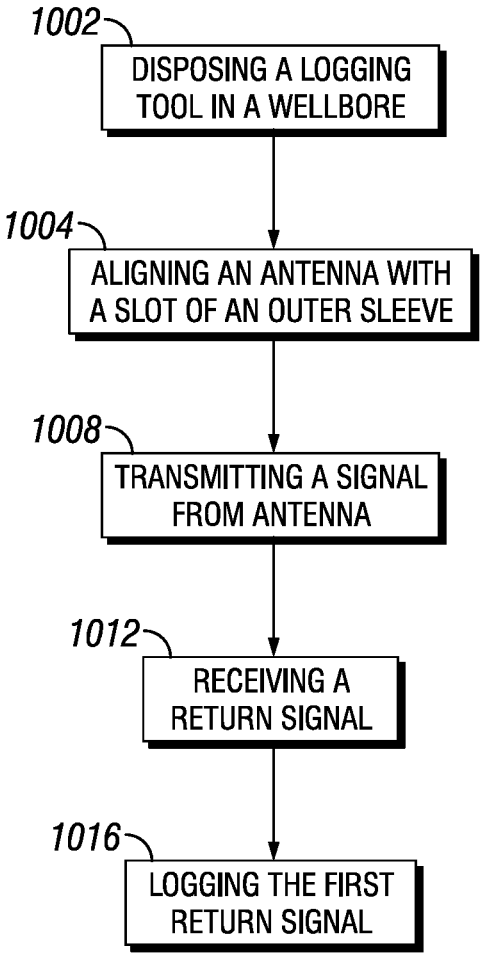
FIG. 10 is a flowchart of logging operation, according to one or more aspects of the present disclosure.

FIG. 10 is a flowchart of a logging operation, according to one or more aspects of the present disclosure. At step 1002, a logging tool, such as logging tool 126 of FIG. 1, is disposed in a wellbore 104 of a formation 106. The logging tool 126 may comprise a sleeve assembly 350. An antenna of the sleeve assembly 350, such as antenna assembly 302 of FIG. 3, may be aligned, at least partially, at step 1004 with a slot 358 disposed in or about an outer sleeve 354 of the sleeve assembly 350. At step 1008, the antenna communicates or transmits a signal through a non-conductive insert 356 disposed in the slot 358 to the formation 106. At step 1012, the logging tool 126 or an antenna of the logging tool 126 receives a return signal. The non-conductive insert 356 comprises a composite material that permits transmission of the signal and receipt of the return signal. At step 1016, the return signal is logged, for example, by a logging facility 206, a surface receiver, a telemetry module 128 or any other logging or memory device. In one or more embodiments, the logging tool utilizes mud telemetry to communicate the return signal to the logging facility 206. In one or more embodiments, the transmitted signal and the return signal are communicated through a non-conductive inner liner comprised of a composite material.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A sleeve assembly, comprising:

an outer sleeve having a plurality of slots;

an antenna positioned in an annulus defined between a portion of a logging tool and the outer sleeve, wherein the antenna is disposed around a drill collar of the logging tool, wherein the outer sleeve is disposed around the antenna;

a non-conductive insert positioned in each slot of the plurality of slots, wherein each non-conductive insert positioned in each of the plurality of slots comprises a first composite material that seals the slot; and a non-conductive inner liner disposed in the annulus of the outer sleeve that adheres to the outer sleeve, wherein the non-conductive inner liner and inserts are bonded or molded into a single structure.

2. The sleeve assembly of claim 1, wherein the antenna is at least partially aligned with one or more of the plurality of slots.

3. The sleeve assembly of claim 1, wherein the non-conductive inner liner comprises a second composite material.

4. The sleeve assembly of claim 3, wherein the non-conductive inner liner is a sleeve that is circumferentially formed in the annulus.

5. The sleeve assembly of claim 3, wherein one or more of the non- conductive inserts each comprise a flange that protrudes radially inwardly from the slot in the outer sleeve.

6. The sleeve assembly of claim 1, wherein one or more of the plurality of slots comprises a beveled edge.

7. The sleeve assembly of claim 1, wherein the non-conductive inner liner is bonded with the outer sleeve such that the non-conductive inner liner is sealed to the outer sleeve.

8. A method of assembling a sleeve assembly, comprising:

forming a plurality of slots in an outer sleeve;

disposing an antenna assembly within an annulus defined between a portion of a logging tool and the outer sleeve, wherein the antenna assembly is disposed around a drill collar, wherein the outer sleeve is disposed around the antenna assembly;

positioning a non-conductive insert in each slot of the outer sleeve, wherein the non-conductive inserts comprises a first composite material;

sealing each slot with the respective non-conductive insert; and disposing a non-conductive inner liner in the annulus of the outer sleeve to adhere to the outer sleeve, wherein the non-conductive inner liner and inserts are bonded or molded into a single structure.

9. The method of claim 8, wherein disposing the antenna assembly comprises aligning the antenna with one or more of the slots.

10. The method of claim 8, wherein the non-conductive inner liner comprises a second composite material.

11. The method of claim 8, wherein positioning the non-conductive insert in each slot of the outer sleeve comprises forming a flange that protrudes radially inwardly from the slot in the outer sleeve.

12. The method of claim 8, wherein disposing the non-conductive inner liner in the annulus comprises forming a sleeve circumferentially about the annulus such that the sleeve adheres to the outer sleeve and the non-conductive insert.

13. The method of claim 8, further comprising forming a beveled edged on one or more of the plurality of slots in the outer sleeve.

14. The method of claim 8, further comprising forming an angled edge on one or more of the plurality of slots in the outer sleeve.

15. The method of claim 8, further comprising at least one of fusing, bonding, curing and molding one or more of the non-conductive inserts in the respective slots of the outer sleeve.

16. The method of claim 8, further comprising bonding the non- conductive inner liner to the outer sleeve such that the non-conductive inner liner is sealed to the outer sleeve.

17. A method of logging in a wellbore of a formation, comprising:

disposing a logging tool in a wellbore, wherein the logging tool comprises a sleeve assembly;

aligning an antenna of an antenna assembly with a slot disposed about an outer sleeve of the sleeve assembly, wherein the antenna assembly is disposed around a portion of the logging tool within an annulus between the logging tool and the sleeve assembly, wherein the antenna is disposed around a drill collar, wherein the outer sleeve is disposed around the antenna;

transmitting a first signal from the antenna through a non-conductive insert disposed in the slot to the formation, wherein the non-conductive insert comprises a first composite material, wherein transmitting the first signal from the antenna comprises transmitting the first signal through a non-conductive inner liner disposed in an annulus of the outer sleeve that is adhered to the outer sleeve, wherein there is a bond between the non-conductive inner liner and the outer sleeve such that the non-conductive inner liner is sealed to the outer sleeve, and wherein the non-conductive inner liner and inserts are bonded or molded into a single structure;

receiving a first return signal associated with the transmitted first signal by the logging tool; and logging the first return signal.

18. The method of claim 17, wherein the non-conductive inner liner comprises a second composite material.

19. The method of claim 17, wherein the insert comprises a flange that adheres to the outer sleeve and protrudes radially inwardly from the slot in the outer sleeve.

* * * * *